US005817195A

United States Patent [19]

Davitz

[11] Patent Number: 5,817,195

[45] Date of Patent: Oct. 6, 1998

[54] SILVER COLORED ALLOY WITH LOW PERCENTAGE OF NICKEL AND COPPER

[75] Inventor: Daniel Davitz, Glenview, Ill.

[73] Assignee: Astrolite Inc., Morton Grove, Ill.

[21] Appl. No.: 752,208

[22] Filed: Nov. 19, 1996

Related U.S. Application Data

[63] Continuation-in-part of Ser. No. 571,756, Dec. 13, 1995.

[51] Int. Cl.[6] ..... C22C 5/00

[52] U.S. Cl. ..... 148/430; 420/500; 420/502; 420/503; 420/504; 148/405

[58] Field of Search ..... 420/500, 502, 420/503, 504; 148/405, 430

[56] References Cited

U.S. PATENT DOCUMENTS 4,944,985 7/1990 Alexander et al. ..... 428/570

4,973,446 11/1990 Bernard et al. ..... 420/504

FOREIGN PATENT DOCUMENTS 59-38346 3/1984 Japan ..... 420/504

*Primary Examiner*—Patrick Ryan

*Assistant Examiner*—M. Alexandra Elve

*Attorney, Agent, or Firm*—Michael, Best & Friedrich

[57] ABSTRACT

A silver colored alloy highly tarnish resistant, sterling silver is provided or having included therein: 90% to 92.5% by weight Silver; 5.75% to 7.5% by weight Zinc; 0.25% to less than 1% by weight Copper; 0.25% to 0.5% by weight Nickel; 0.1% to 0.25% by weight Silicon; and 0.0% to 0.5% by weight Indium.

5 Claims, No Drawings

SILVER COLORED ALLOY WITH LOW PERCENTAGE OF NICKEL AND COPPER

This is a continuation-in-part of U.S. patent application Ser. No. 08/571,756, filed Dec. 13, 1995.

BACKGROUND OF THE INVENTION

1. Field of the Invention

The invention relates generally to Silver Alloys, and specifically to Sterling Silver Alloys having improved tarnish resistance, and casting qualities. Preferably this alloy must be moldable and castable with low surface tension to conform to intricate molds. In addition, the alloy should provide a material which does not easily tarnish.

2. Prior Art

Sterling Silver jewelry and utensils are valued because of their intrinsic worth and the silver color of the metal. However, problems occur due to the tendency of sterling silver to tarnish easily and usually be brittle after casting.

Many attempts have been made to improve the tarnish resistance and corrosion resistance of sterling silver and to improve the casting qualities of the alloy.

SUMMARY OF THE INVENTION

Accordingly, the object of this invention is to provide a more corrosion resistance and tarnish resistant silver alloy with better working properties than regular sterling silver.

For example, an alloy called Precium comprises of 74% Silver, 25% Palladium, 1% Indium. Another alloy previously sold is 66% Silver, 23% Palladium, 1% Indium. U.S. Pat. No. 4,944,985 to Alexander, discloses a silver alloy for plating that uses silica as an extender but not pure metal silicate as in the present invention or for improved casting properties. Rather, silicate in combination with other materials is disclosed. Alexander et al further discloses that ductility and smooth surface finish are desirable, but does not describe how to prevent brittleness. Further, Alexander et al describes the use of silicates as extenders, which are defined as making casting easier and increasing the volume of the alloy using low cost materials. The present invention teaches an alloy which increases the fluidity over alloys of the prior art.

Japanese Patent No. 59038-346A teaches an alloy that has Zinc and Nickel with overlapping ranges to the present invention. However, the amount of Copper in the present invention is less than that of the Japanese reference and the reference further teaches Indium in a concentration less than the present invention, and use of Bismuth where Bismuth is not used in the present invention. However these alloys have been found to be too expensive for substantial commercial use. Applicant has invented a sterling silver alloy which is the subject of a U.S. Pat. No. 5,037,708. However, a lower cost silver alloy is desirable.

Japanese Patent No. 62-243725 teaches a jewelry alloy with concentrations of Silver, Zinc, Indium and Copper with ranges that overlap in those of the present invention. However, as pointed out by the Examiner in the parent application, the reference does not teach the use of silicates in the prior alloys nor the physical properties of casting and melting temperatures taught by the prior art nor the intended use for jewelry. U.S. Pat. No. 4,869,757 teaches the use of Nickel, Iridium or Lithium as grain refiners. However, applicant respectfully submits that although U.S. Pat. No. 4,869,757 does teach use of Nickel, Iridium or Lithium as grain refiners, the use of Lithium in the Japanese Patent No. 5,9038-346-A is to reduce the discharge consumption, not as a grain refiner and that accordingly the present invention is patentably distinct therefrom.

Accordingly, an object of the present invention is a silver alloy having chemical and physical properties suitable for use in jewelry.

An additional object of the present invention is to provide a silver color alloy, that will provide better tarnish resistance, corrosion resistance and better working properties and still have a low cost alloy. Better working properties refers among other things to non-brittle metal. This is different from ductility in that ductility refers to capable of being drawn out or hammered thin whereas brittleness refers to easily broken, cracked or snapped, both definitions being from Webster's New Collegiate Dictionary.

Other objects of the present invention and advantages accruing therefrom will be apparent to one skilled in the art in the following description. All percentages referred to are percent by weight on the total weight of the material or mixture.

In accordance with this invention, an alloy is provided which contains Silver, Zinc, Nickel and may contain a low percentage of Indium and Metal Silicate. This alloy polishes and works like sterling silver as well as it has the appearance of sterling silver. In 5% Chlorine atmosphere, the invention is found to be very superior to sterling silver containing 92.5% by weight Silver and 7.5% by weight Copper and in fact it showed no discolorization while the sterling silver turned black. The same prevention of discoloration occurred when the present invention was placed in a sulfur gas atmosphere for 24 hours, the invention was still bright and the sterling silver tarnished.

Accordingly, an object of the invention is to provide a more corrosion resistant and tarnish resistant alloy provided by taking out most of the Copper and replacing the Copper with Zinc and by using a low percentage by weight of Nickel as a grain refiner.

An additional object of this invention is a metal alloy having chemical and physical properties suitable for use in jewelry.

An additional object of this invention is a silver alloy, using Zinc and Nickel that will reduce tarnishing, increase corrosion resistance with better working properties by reducing brittleness and still have a low cost alloy.

Other objects of the present invention and advantages accruing therefrom will be apparent to one who is skilled in the art in the following description. All percentages referred to are percent by weight based on the total weight of the material or mixture.

DETAILED DESCRIPTION OF THE PREFERRED EMBODIMENTS

In accordance with the present invention, a silver colored metal alloy is disclosed which is more tarnish resistant, corrosion resistant and with better working properties and consisting of the following ingredients: 90% to 94% by weight Silver, 0.25% to 0.5% by weight Nickel, 0.1% to 0.25% by weight Metal Silicate being approximately 98.5% pure, 7.5% to 5.75% by weight Zinc, 0.25% to less than 1% by weight Copper, and 0 to 0.5% by weight Indium.

To be considered in the sterling family we must use 92.5% by weight Silver and usually the element used to make up the balance to 100% is Copper. But in this invention most or all the Copper is replaced to enhance the tarnish resistance and the corrosion resistance by the replacement of most of the Copper with Zinc. We found that this gives us a more stable color alloy than sterling silver but also due to the addition of Nickel, a finer grain alloy which helps eliminate the brittleness of sterling silver after casting. In a preferred embodiment, the ratio of Silver is reduced due to cost, and to be considered like sterling silver is 92.5% by weight Silver, 6.82% by weight Zinc, 0.25% by weight Copper, 0.25% by weight Zinc, and 0.18% by weight Metal Silicate. If using Indium then 0.25% by weight Indium and we lower the Zinc by 0.25% by weight to 6.57% by weight Zinc. Zinc enhances color and helps in the tarnish and corrosion resistance, Metal Silicate makes smoother castings by making the molten metal more fluid, Nickel gives the alloy a finer grain structure and must be added to the alloy with equal amount of Copper to cause all the constituents to remain in solution.

The specific gravity of the alloy is 8.85 GR/CC plus or minus 0.5 GMS/CC. Other physical properties are:

Low Hardness 90 Brinell Heat treated in furnace 850 degrees F. and Quenched.

High Hardness 160 Brinell Hardness heat treated in furnace 850 degrees F. and bench cooled.

Elongation 15% to 28%

Specifically, the preferred alloy formula in accordance with the invention is:

| | |
|---|---|
| Silver | 92.5% By Weight |
| Zinc | 6.57% By Weight |
| Copper | .25% By Weight |
| Nickel | .25% By Weight |
| Metal Silicate | .18% By Weight |
| Indium | .25% By Weight |

While this invention has been describe with reference to a preferred content and formula, it will be understood by those skilled in the art that various changes may be made and equivalents substituted for elements described herein without departing from the scope of the invention. In addition, many modifications may be made to adapt to a particular situation or material to the teachings of the invention without departing from the scope of the invention. Therefore, it is intended that the invention cannot be limited to the particular embodiment disclosed as the best mode contemplated for carrying out this invention, but that the invention will include all embodiments falling within scope of the appended claims.

I claim as my invention:

1. A silver colored alloy highly tarnish resistant, corrosion resistant and non-brittle free alloy which comprises:

90% to 92.5% by weight silver;

0.25% to 0.5% by weight nickel;

0% to 0.5% by weight indium; and metal silicate consisting of 5.75% to 7.5% zinc by weight of the silver colored alloy;

0. 25% to <1% copper by weight of the silver colored alloy; and 0.1% to 0.25% silicon by weight of the silver colored alloy.

2. The alloy of claim 1, wherein the casting temperature is 1760 degrees F. plus or minus 50 degrees.

3. The alloy of claim 1, wherein the melting temperature is 1650 degrees F. plus or minus 50 degrees.

4. A jewelry alloy suitable for rings, earrings and bangles, containing 92.5% by weight silver, 6.82% by weight zinc, 0.25% by weight copper, 0.25% by weight nickel and 0.18% by weight silicon.

5. A silver colored alloy highly tarnish resistance, corrosion resistant and brittleness free consisting essentially of:

90% to 92.5% by weight silver;

0.25% to <0.5% by weight nickel;

0% to 0.5% by weight indium; and metal silicate consisting of 5.75% to 7.5% by weight zinc of said silver colored alloy:

0.25% to <1% by weight copper of said silver colored alloy; and 0.1% to 0.25% by weight silicon.

* * * * *